United States Patent [19]

Riegel, Jr.

[11] Patent Number: 4,823,913

[45] Date of Patent: Apr. 25, 1989

[54] SIMPLIFIED SELF SUPPORTING SCAFFOLD STRUCTURE HAVING SAFETY FEATURES

[76] Inventor: Clifford S. Riegel, Jr., 12251 Eagle Rd., New Lebanon, Ohio 45345

[21] Appl. No.: 186,803

[22] Filed: Apr. 27, 1988

[51] Int. Cl.[4] ..... B27B 21/00; B25H 1/06; E04G 3/04

[52] U.S. Cl. ..... 182/225; 182/184; 182/227

[58] Field of Search ..... 182/230, 224, 225, 181–186, 182/214, 82, 227

[56] References Cited

U.S. PATENT DOCUMENTS

| | | | |
|---|---|---|---|
| 1,018,658 | 2/1912 | Fuller . | |
| 1,107,098 | 8/1914 | Opelt . | |
| 1,224,893 | 5/1917 | Beckwith . | |
| 1,261,007 | 2/1918 | Beardsley . | |
| 1,725,168 | 8/1929 | Willis . | |
| 1,749,706 | 3/1930 | Kingston | 182/225 |
| 2,272,957 | 2/1942 | Walp . | |
| 2,290,535 | 7/1942 | Cavins . | |
| 2,325,592 | 8/1943 | Degler . | |
| 2,398,604 | 4/1946 | Thorne . | |
| 2,578,119 | 12/1951 | Yench | 182/117 |
| 2,588,399 | 3/1952 | McQuin | 182/224 |
| 2,636,785 | 4/1953 | Albrecht | 182/224 |
| 2,767,898 | 10/1956 | Cramer . | |
| 2,966,957 | 1/1961 | Ireland . | |
| 4,078,633 | 3/1978 | Fahy . | |
| 4,241,808 | 12/1980 | Middleton . | |
| 4,640,385 | 2/1987 | Underhill | 182/224 |

*Primary Examiner*—Reinaldo P. Machado
*Attorney, Agent, or Firm*—Jacox & Meckstroth

[57] ABSTRACT

Scaffold structure which is adapted to be positioned adjacent a wall and to engage a wall. The scaffold structure has a pair of legs which support a load support member. A brace is attached to the load support member and extends angularly therefrom. The brace has a portion which engages a wall so that the load support member is horizontal and the scaffold structure in a firm relationship with respect to the wall even though the brace is not attached to the wall.

17 Claims, 2 Drawing Sheets

FIG-1
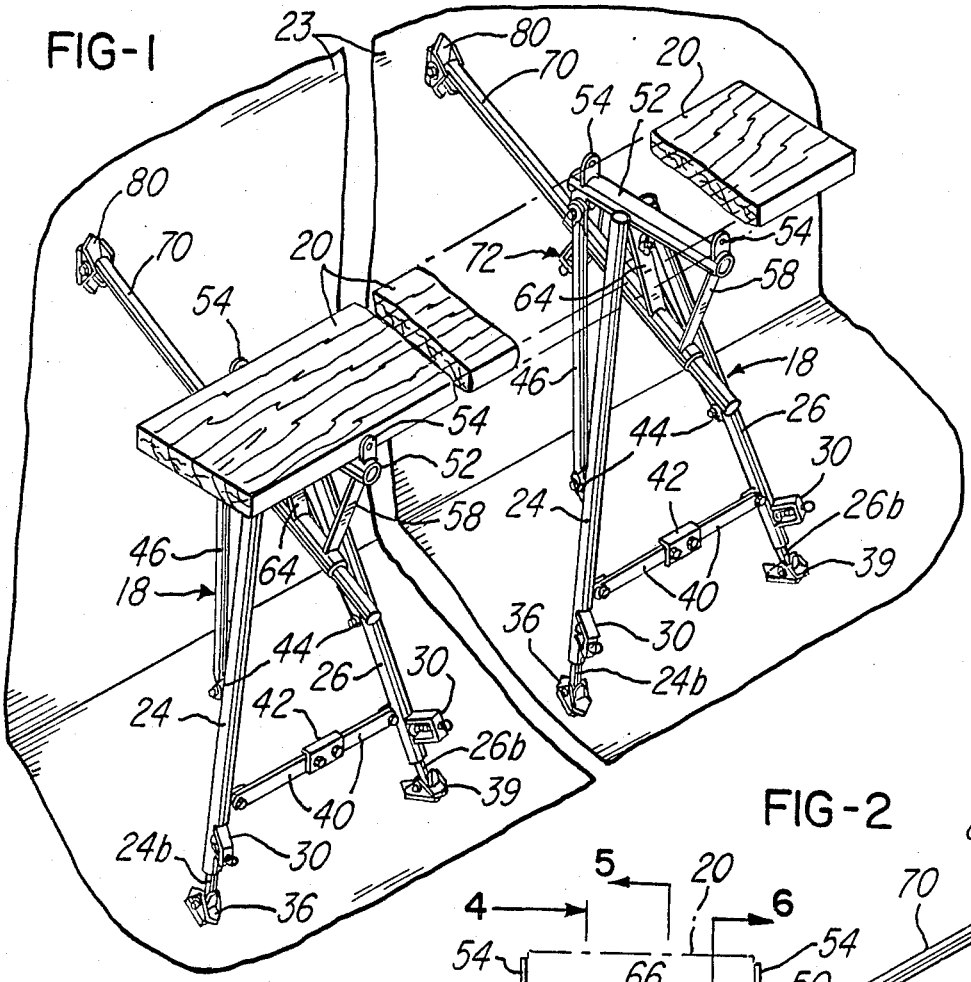
FIG-2
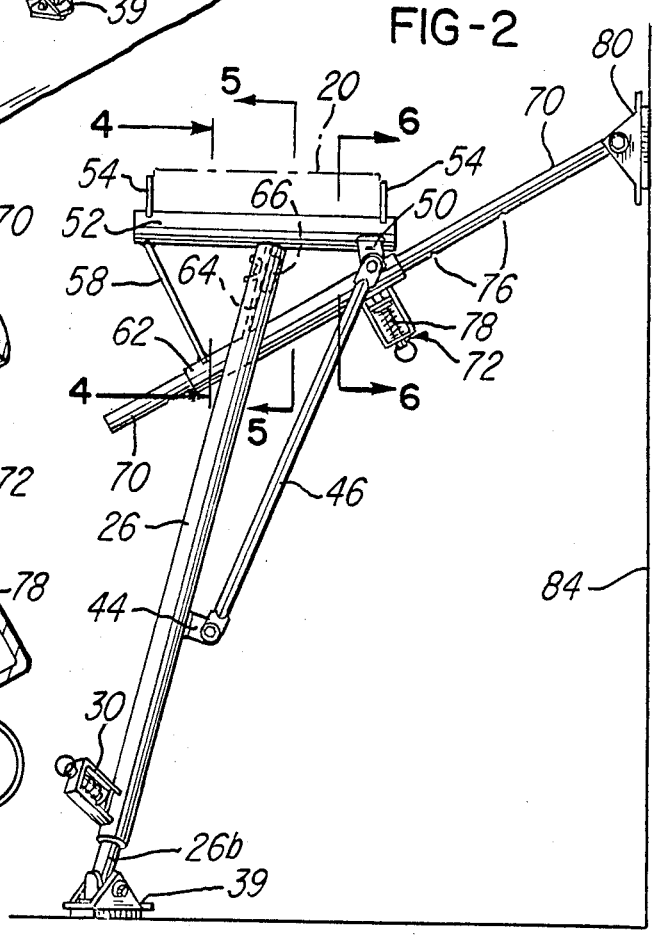
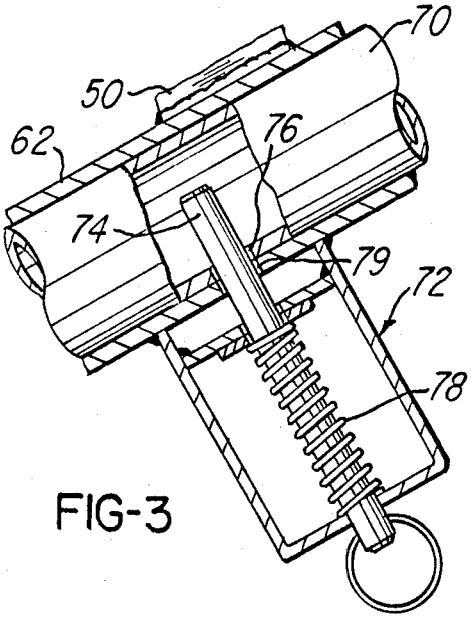
FIG-3

SIMPLIFIED SELF SUPPORTING SCAFFOLD STRUCTURE HAVING SAFETY FEATURES

BACKGROUND OF THE INVENTION

Numerous types of scaffold structures have been created. However, many of the scaffold structures are those which are complex and/or those which provide questionable safety to the user.

Most scaffold structures require attachment to an adjacent structure, such as a building or the like in order to provide adequate support for a load or person on the scaffold structure. However, in many situations it is not possible or practical to attach a scaffold structure to an adjacent wall. Furthermore, attachment of a scaffold structure to a wall is time consuming.

Self supporting scaffold structures have been used. However, several problems exist in regard to self supporting scaffold structures. Proper self supporting scaffold structure must enable a workman to work safely as the workman is supported by the scaffold structure. Self supporting scaffold structure must be constructed so that a workman cannot stand or place a load on a portion which would cause the support structure to fall. In other words, a self supporting scaffold structure must include a defined section upon which a workman can be supported and upon which a load can be supported. The self supporting scaffold structure must be constructed so that a workman will not have a tendency to stand or to place a load upon any portion of the structure other than that section which is designated for supporting a workman and/or load.

The following known patents pertain to scaffold structures. However, none of these patents shows scaffold structure which wolve the problems set forth above and which have the construction and advantages of the self supporting scaffold structure of this invention: U.S. Pat. Nos. 1,018,658, 1,107,098, 1,224,893, 1,261,007, 1,725,168, 2,272,957, 2,290,535, 2,325,592, 2,398,604, 2,767,898, 2,966,957, 4,078,633, 4,241,808.

It is an object of this invention to provide a simplified self supporting scaffold structure which does not need to be attached to another structure during use thereof and which includes safety features.

It is another object of this invention to provide such self supporting scaffold structure which includes a defined portion for support of a workman and in which no other portion of the scaffold structure can be considered for use for support of a workman or a load. Thus, maximum safety is provided.

It is another object of this invention to provide such a self supporting scaffold structure which is very stable when positioned in engagement with a wall or the like.

It is another object of this invention to provide such self supporting scaffold structure which is foldable and collapsable for transportation thereof and/or for storage thereof.

Other objects and advantages of this invention reside in the construction of parts, the combination thereof, and the mode of use, as will become more apparent from the following description.

SUMMARY OF THE INVENTION

Simplified self supporting scaffold structure of this invention comprises a horizontal load support members which is intended for support of a plank or the like. A pair of upwardly extending legs support the load support member. The legs are directly below the load support member. Thus, the load support member is located at a position in which a load can be firmly supported by the legs. The load support member of the self supporting scaffold structure is well defined as the only part of the scaffold structure which is adapted to support a load. Thus, a workman can expect to be supported or to place a load only upon the part of the scaffold structure which is clearly defined as a load supporting member.

An upwardly inclined brace member is attached to the load support member of the scaffold structure. The brace member is adapted to engage a wall or the like upon which work is being performed as a worker is supported by the load support member. Due to the fact that the brace member is angularly upwardly inclined with respect to the load support member, the scaffold structure is firmly braced, without attachment to the wall. Furthermore, the inclined brace member does not present a suitable position upon which a workman may tend to stand or upon which to place a load. Therefore, the scaffold structure presents safe support structure for a workman, even though the scaffold structure is not attached to the wall.

BRIEF DESCRIPTION OF THE VIEWS OF THE DRAWING

FIG. 1 is a perspective view of self supporting scaffold structure of this invention, as the scaffold structure is in engagement with a wall of a building or the like.

FIG. 2 is a side elevational view of the scaffold structure of invention, and drawn on a slightly larger scale than FIG. 1.

FIG. 3 is a fragmentary side sectional view, with parts broken away, and drawn on a larger scale than FIGS. 1 and 2, illustrating the locking and adjustment mechanism for the brace member in the scaffold structure of this invention.

DETAILED DESCRIPTION OF THE PREFERRED EMBODIMENT

Figure 4:
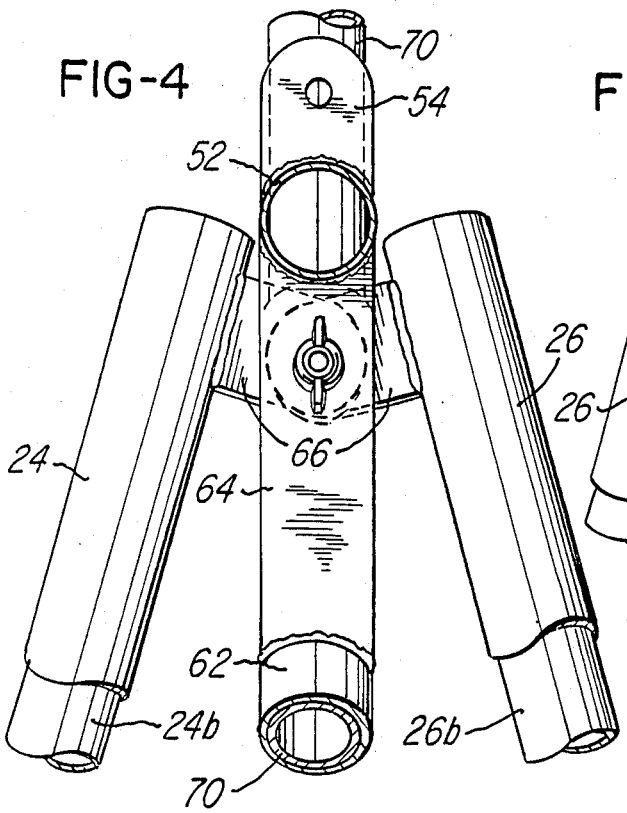
FIG. 4 is an enlarged fragmentary sectional view taken substantially on line 4—4 of FIG. 2.
Figure 5:
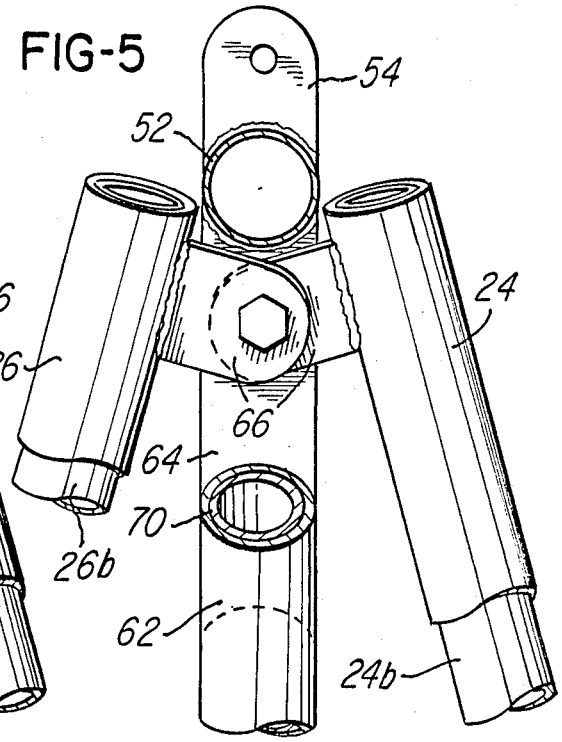
FIG. 5 is an enlarged fragmentary sectional view taken substantially on line 5—5 of FIG. 2.
Figure 6:
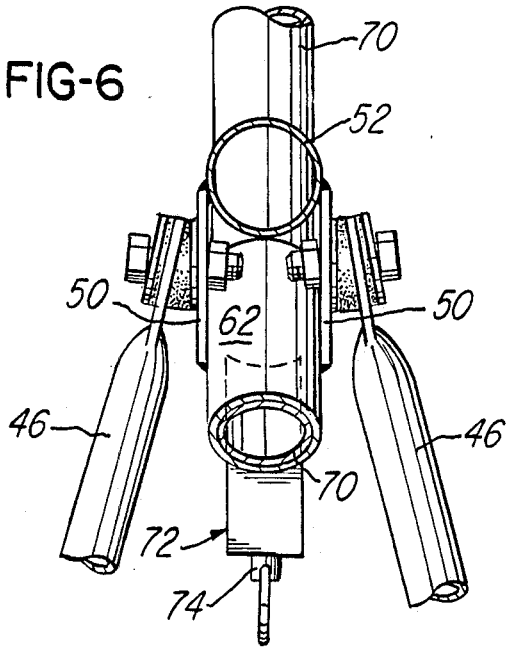
FIG. 6 is an enlarged fragmentary sectional view taken substantially on line 6—6 of FIG. 2.

Self Supporting scaffold support structure 18 of this invention is adapted to support any suitable support member such as a plank 20 or the like as illustrated in FIG. 1. The plank 20 may be of any suitable material and of any suitable dimensions. FIG. 1 shows two support structures 18 of this invention which are spaced apart and which support the plank 20. The support structures 18 are shown in engagement with a wall 23.

Each support structure 18 comprises a leg 24 and a leg 26. The leg 24 has an extension portion **24*b* which is axially adjustable with respect to the leg 24. The leg 26 has an extension portion 26*b* which is axially adjustable with respect to the leg 26**.

A lock pin mechanism 30 is attached to each of the legs 24 and 26 and is employed to secure the leg extensions **24*b* and 26*b* in any adjusted position with respect to the legs 24 and 26**, respectively.

Attached to the lower end of the leg extension **24*b* is a foot member 36. Attached to the lower end of the leg extension 26*b* is a foot 39**.

As shown in FIG. 1, a cross member 40 is pivotally attached to the leg 24 and to the leg 26. A connector member 42 pivotally attaches together portions of the cross member 40 and secures the horizontal position of the cross member 40.

A bracket 44 is attached to each of the legs 24 and 26 intermediate the ends thereof. Pivotally attached to each bracket 44 is a stem 46. Each stem 46 extends angularly upwardly from its respective bracket 44. Each stem 46 has an upper end pivotally attached to a bracket 50 which is secured to a load support member 52. One of the brackets 50 is positioned on each of opposite sides of the load support member 52, and the stems 46 are on opposite sides of the load support member 52. The upper ends of the legs 24 and 26 are closely positioned o opposite sides of the load support member 52. Attached to the load support member 52 at the upper surface thereof are spaced-apart protuberances 54.

Extending downwardly from one end portion of the load support member 52 and secured thereto is a connector member 58. Also, below the load support member 52 is brace 62. The connector member 58 has a lower end secured to the brace 62. Also, attached to the load support member 52 on the lower surface thereof, intermediate the ends thereof, is a connector member 64 which extends downwardly from the load support member 52 and has a lower end secured to the brace 62.

Secured to the upper end portion of each of the leg members 24 and 26 is a lug 66. Each lug 66 is pivotally attached to the connector member 64.

The upper portion of the brace 62 is attached to the brackets 50 which are also pivotally attached to the stems 46.

Extending axially from the brace 62 is a brace extension 70. Due to the fact that the brace 62 is upwardly inclined, the brace extension 70 is upwardly inclined. The brace extension 70 is axially adjustable with respect to the brace 62 and is secured in any adjusted position by means of a locking device 72. As shown in FIG. 3, the locking device 72 includes a pin 74 which is movable into any one of a series of openings 76 along the brace extension 70. A spring 78 urges the pin 74 through an opening 79 in the brace 62 and into one of the openings 76 of the brace extension 70. The brace 62 and the brace extension 70 form brace structure in the support structure 18. The brace 62 is below the load support member 52, and the brace 62 and the brace extension 70 are preferably substantially in the same plane as the load support member 52.

At the upper end of the brace extension 70 is an engagement member 80.

The engagement member 80 of the brace extension 70 is positioned against a wall 84, and the legs 24 and 26 are positioned upon a support surface adjacent the wall 84 so that the load support member 52 is horizontal.

Thus, the plank 20 which is positioned upon the load support member 52 is horizontal, as shown in FIGS. 1 and 2. The plank 20 is positioned and retained between the protuberances 54 which are upon the upper surface of the load support member 52.

The legs 24 and 26 are directly below the load support member 52 and are firmly attached thereto. Preferably, the legs 24 and 26 are in a plane which intersects the load support member 52. The legs 24 and 26 and the stems 46 and the connector member 58 firmly support the load support member 52.

Due to the fact that the brace 62 is below the load support member 52, and due to the fact that the brace 62 and brace extension 70 are angularly inclined, it is obvious that the only portion of the scaffold structure upon which to stand or to place a load is the load support member 52. Therefore, the possibility that a workman would attempt to stand on any other part of the scaffold structure or to place a load on any other portion of the scaffold structure is very remote. Therefore, when the engagement member 80 of the brace extension 70 is in engagement with a wall, such as the wall 84, and when the load support member 52 is horizontal, a person who stands on the plank 20 can work in safety.

Such safety is possible, even though the engagement member 80, which is in engagement with the wall 84, is not attached to the wall 84.

Thus, it is understood that self supporting scaffold structure of this invention provides a sturdy and safe basis upon which a person can work. The scaffold structure is readily positioned adjacent a wall and in engagement with a wall, without the need for attachment of the scaffold structure to the wall.

It is apparent from the construction shown and discussed that the parts of the scaffold structure can be readily retracted to a minimum length, and the scaffold structure can be folded or collapsed to a relatively compact size for transportation and/or for storage.

Although the preferred embodiment of the self supporting scaffold structure of this invention has been described, it will be understood that within the purview of this invention various changes may be made in the form, details, proportion and arrangement of parts, the combination thereof, and the manner of use, which generally stated consist in a self supporting scaffold structure within the scope of the appended claims.

The invention having thus been described, the following is claimed:

1. Self supporting scaffold structure adapted to be positioned adjacent a wall surface, the support structure being adapted to rest upon a support surface adjacent the wall surface and engaging the wall surface comprising:

a pair of upwardly extending leg members, each of the leg members having a lower portion and an upper portion, a load support member having a forward portion and a rearward portion and an intermediate portion, means attaching the intermediate portion of the load support member to the upper portion of the leg members, a pair of stem members, means attaching each stem member to one of the leg members between the lower portion of the leg member and the upper portion of the leg member, means attaching each stem member to the forward portion of the load support member, a brace member having a connection portion positioned below the load support member, means attaching the connection portion of the brace member to the rearward portion of the load support member, and means attaching the connection portion of the brace member to the forward portion of the load support member, the brace member including an extension portion which extends angularly upwardly from the connection portion thereof, the brace member having an end part adapted to engage a wall surface to maintain the load support member in a substantially horizontal plane.

2. The self supporting scaffold structure of claim 1 which includes a pair of lugs, there being one lug attached to each of the leg members adjacent the upper portion thereof, a tab attached to the intermediate portion of the load support member, and means attaching together the tab and the lugs.

3. The self supporting scaffold structure of claim 1 which includes a pair of lugs, there being one lug attached to each of the stem members and to the forward portion of the load support member.

4. The self supporting scaffold structure of claim 1 which includes connection means attached to the lower portion of the leg members and joining together the leg members.

5. The self supporting scaffold structure of claim 1 in which the connection portion of the brace member is angular with respect to the load support member.

6. The self supporting scaffold structure of claim 1 in which the load support member and the brace member are in substantially the same plane.

7. The self supporting scaffold structure of claim 1 wherein the leg members are in a given plane and the given plane intersects the load support member.

8. The self supporting scaffold structure of claim 1 which includes an elongate connection member attached to the rearward portion of the load support member and to the connection portion of the brace member.

9. The self supporting scaffold structure of claim 1 in which the extension portion of the brace member is telescopially joined to the connection portion of the brace member.

10. The self supporting scaffold structure of claim 1 which includes a plurality of extension members, there being an extension member which extends from each of the leg members and which is adjustably axially movable with respect thereto.

11. The self supporting scaffold structure of claim 1 which includes a pair of retention members, there being a retention member attached to the load support member and extending upwardly therefrom at forward portion thereof, there being retention member attached to the load support member and extending upwardly therefrom at the rearward portion thereof, the retention members defining a load support portion of the load support member.

12. Self supporting scaffold structure adapted to be positioned upon a support surface adjacent a wall surface or the like, comprising:

a pair of upstanding leg members, the leg members being adapted to be supported upon a support surface adjacent a wall surface, a substantially horizontal load support member, means attaching the load support member to the leg members, a brace member having an attachment portion positioned adjacent the load support member, the brace member having a portion angularly inclined with respect to the load support member, means attaching the attachment portion of the brace member to the load support member, a pair of stem members, means attaching each stem member to one of the leg members, means attaching each stem member to the load support member, and connection means attaching the load support member to the attachment portion of the brace member, the brace member having an extension portion extending angularly upwardly from a position adjacent the load support member, the brace member having a portion engageable with the wall surface, the scaffold structure thus being easily and readily positioned adjacent the wall surface, the scaffold structure thus providing stable support for a load which is supported upon the load support member, the load support member thus providing stable support for a person who is supported upon the load support member and who works upon the wall surface or adjacent the wall surface.

13. Self supporting scaffold structure adapted to be positioned upon a support surface adjacent a wall surface or the like, comprising:

a pair of upstanding leg members, the leg members being adapted to be supported upon a support surface adjacent a wall surface, a substantially horizontal load support member, means attaching the load support member to the leg members, a brace member having an attachment portion positioned adjacent the load support member, the brace member having a portion angularly inclined with respect to the load support member, means attaching the attachment portion of the brace member to the load support member, plurality of stem members, means attaching each stem member to one of the leg members, means attaching each stem member to the load support member, means attaching the leg members to the load support member, and means attaching the load support member to the attachment portion of the brace member, the brace member having an extension portion extending angularly upwardly from a position adjacent the load support member, the brace member having a portion engageable with the wall surface, the scaffold structure thus being easily and readily positioned adjacent the wall surface, the structure thus providing stable support for a load which is supported upon the load support member, the load support member thus providing stable support for a person who is supported upon the load support member and who works upon the wall surface or adjacent the wall surface.

14. Self supporting scaffold structure adapted to be positioned upon a support surface adjacent a wall surface or the like, comprising:

a pair of upstanding leg members, the leg members being adapted to be supported upon a support surface adjacent a wall surface, a substantially horizontal load support member, means attaching the load support member to the leg members, a brace member having an attachment portion positioned adjacent the load support member, the brace member having a portion angularly inclined with respect to the load support member, means attaching the attachment portion of the brace member to the load support member, the load support member having a forward portion and a rearward portion, each of the leg members having an upper portion and a lower portion, a pair of stem members, means attaching each stem member to one of the leg members between the upper portion thereof and the lower portion thereof, means attaching each stem member to the forward portion of the load support member, and means attaching the upper portion of the leg members to the load support member intermediate the forward portion of the load support member and the rearward portion of the load support member, a first connection member, the first connection member attaching the rearward portion of the load support member to the attachment portion of the brace member, a second connection member, the second connection member attaching the forward portion of the load support member to the attachment portion of the brace member, the brace member having an extension portion extending angularly upwardly from a position adjacent the forward portion of the load support member, and means for adjustably positioning the extension portion of the brace member with respect to the attachment portion of the brace member, the brace member having a portion engageable with the wall surface, the scaffold structure thus being easily and readily positioned adjacent the wall surface, the scaffold structure thus providing stable support for a load which is supported upon the load support member, the load support member thus providing stable support for a person who is supported upon the load support member and who works upon the wall surface or adjacent the wall surface.

15. Self supporting scaffold structure adapted to be positioned upon a support surface adjacent a wall surface or the like, comprising:

a pair of upstanding leg members, the leg members being adapted to be supported upon a support surface adjacent a wall surface, a substantially horizontal load support member, means attaching the load support member to the leg members, both of the leg members being in the same plane and in a plane which intersects the load support member, a brace member having an attachment portion positioned adjacent the load support member, the brace member having a lowermost portion adjacent the load support member, the brace member being positioned between the leg members, the brace member having a portion angularly inclined with respect to the load support member, and means attaching the attachment portion of the brace member to the load support member, the brace member having a portion engageable with the wall surface, the scaffold structure thus being easily and readily positioned adjacent the wall surface, the scaffold structure thus providing stable support for a load which is supported upon the load support member, the load support member thus providing stable support for a person who is supported upon the load support member and who works upon the wall surface or adjacent the wall surface.

16. Self supporting scaffold structure adapted to be positioned upon a support surface adjacent a wall surface or the like, comprising:

a pair of upstanding leg members, each of the leg members having a foot portion adapted to be supported upon a support surface adjacent a wall surface, a substantially horizontal load support member, the horizontal load support member having a pair of end portions and an intermediate portion, the intermediate portion being between the end portions, means attaching intermediate portion of the load support member to the leg members, a brace member having an attachment portion positioned adjacent the load support member, the brace member having a portion angularly inclined with respect to the load support member, the brace member having a lowermost portion spaced significantly above the foot portions of the leg members, and means attaching the attachment portion of the brace member to the load support member, the brace member having a portion engageable with the wall surface, the scaffold structure thus being easily and readily positioned adjacent the wall surface, the scaffold structure thus providing a stable support for a load which is supported upon the load support member, the load support member thus providing stable support for a person who is supported upon the load support member and who works upon the wall surface or adjacent the wall surface.

17. Self supporting scaffold structure for positioning adjacent a wall, comprising:

a plurality of upstanding leg members, the leg members being inclined one toward the other, a load support member, the load support member being provided with a pair of end portions and an intermediate portion, the intermediate portion being between the end portions, means attaching the leg members to intermediate portion of the load support member, a brace member positioned angularly with respect to the load support member, the brace member being positioned between the upper portions of the leg members, and means attaching the brace member to the load support member, wherein the leg members are adapted to be positioned adjacent a wall and wherein the brace member is adapted to engage the wall and to maintain the load support member in substantially horizontal orientation.

* * * * *